US011225093B2

(12) United States Patent
Schulkes

(10) Patent No.: US 11,225,093 B2
(45) Date of Patent: Jan. 18, 2022

(54) SUPPORT STRUCTURE DEFINING A FLAT SUPPORT SURFACE

(71) Applicant: Océ Holding B.V., Venlo (NL)

(72) Inventor: Joseph A. Schulkes, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 407 days.

(21) Appl. No.: 16/532,670

(22) Filed: Aug. 6, 2019

(65) Prior Publication Data

US 2020/0055323 A1 Feb. 20, 2020

(30) Foreign Application Priority Data

Aug. 14, 2018 (EP) ..... 18188963

(51) Int. Cl.

| | |
|---|---|
| ***B41J 11/06*** | (2006.01) |
| ***B41J 29/02*** | (2006.01) |
| ***B41J 11/00*** | (2006.01) |
| *B65H 5/22* | (2006.01) |

(52) U.S. Cl.

CPC ..... *B41J 11/06* (2013.01); *B41J 11/007* (2013.01); *B41J 11/0085* (2013.01); *B41J 29/02* (2013.01); *B65H 5/224* (2013.01)

(58) Field of Classification Search

CPC ..... B41J 11/007; B41J 11/0085; B41J 11/06; B41J 29/02

See application file for complete search history.

(56) References Cited

U.S. PATENT DOCUMENTS 1,569,917 A * 1/1926 Foothorap ..... B41J 11/06 400/37
6,460,990 B2 * 10/2002 Yraceburu ..... B41J 11/007 347/102
8,287,068 B2 * 10/2012 Shimizu ..... B41J 11/007 347/9
9,180,694 B2 * 11/2015 Yoshino ..... B41J 11/06
9,669,641 B2 * 6/2017 Holtman ..... B41J 11/06
2017/0239959 A1 8/2017 Sanchis Estruch et al.

FOREIGN PATENT DOCUMENTS

WO WO 2016/076833 A1 5/2016

OTHER PUBLICATIONS

Search Report for European Patent Application No. 18188963, completed on Mar. 4, 2019.

* cited by examiner

*Primary Examiner* — Jill E Culler
(74) *Attorney, Agent, or Firm* — Birch, Stewart, Kolasch & Birch, LLP

(57) ABSTRACT

A support structure defining a flat support surface for supporting a web material includes a number of beams, each having a cross-section elongated in a first direction normal to the support surface. The beams have a ruler edge extending in a second direction in parallel with the support surface, which is defined by the ruler edges. The support structure includes a number of adjustment mechanisms for adjusting the positions of the ruler edges in the first direction. Each beam has a base part and a ruler part, the ruler part defining the ruler edge and being connected to the base part by at least three adjustment mechanisms distributed over the length of the beam. Each adjustment mechanism includes a lever that is pivotable relative to the base part about a fixed fulcrum, is connected to the ruler part, and has an adjustment arm with an adjustable free end.

15 Claims, 2 Drawing Sheets

SUPPORT STRUCTURE DEFINING A FLAT SUPPORT SURFACE

The invention relates to a support structure defining a flat support surface for supporting a web material, the support structure comprising a number of beams each of which has a cross-section elongated in a first direction normal to the support surface, the beam having a ruler edge extending in a second direction in parallel with the support surface, the support surface being defined by the ruler edges of the beams, the support structure further comprising a number of adjustment mechanisms for adjusting the positions of the ruler edges in the first direction.

More particularly, the invention relates to a support structure for supporting an air-permeable conveyer belt that serves as a recording media platen in a printer and runs over a suction box the top surface of which is constituted by the support surface.

In order to achieve a high print quality in a printer, e.g. an ink jet printer, it is essential that the media platen is perfectly flat. It is therefore desired that the support structure permits to control the curvature of the support surface so as to eliminate any undesired curvature that may result from mechanical or thermal strain.

US 2017239959 A1 discloses a support structure of the type indicated above, wherein adjustment mechanisms are provided for adjusting the height and inclination of the beams.

It is an object of the invention to provide a low-cost support structure with which the curvature of the support surface can be controlled more finely.

In order to achieve this object, according to the invention, each beam has a base part and a ruler part, the ruler part defining the ruler edge and being connected to the base part by at least three adjustment mechanisms distributed over the length of the beam, and each adjustment mechanism comprises a lever that is pivotable relative to the base part about a fixed fulcrum, is connected to the ruler part by an articulated link, and has an adjustment arm with a free end that is adjustable in its position in the first direction relative to the base part.

Since at least three adjustment mechanisms are provided per beam, it is possible to control not only the inclination of the beam but also to bend the beams so as to control their curvature. The adjustment arm of each adjustment mechanism provides a certain leverage for applying a sufficient bending force to the ruler part of the beam and at the same time permitting to control the curvature with high accuracy.

It is another advantage of the invention that the ruler parts of the beams are connected to the base parts only locally via a relatively small number of articulated links, so that the ruler parts of the beams and, accordingly, the support surface is thermally insulated from the rest of the support structure. This facilitates to keep the recording media at a uniform temperature.

More specific optional features of the invention are indicated in the dependent claims.

The ruler part, the base part and the levers constituting the adjustment mechanisms of each beam may be formed in one piece from a sheet metal in which the contours of the levers, the fulcrum, and the articulated link have been formed e.g. by means of laser cutting.

The support surface may be constituted by a two-dimensional array of rollers arranged in a plurality of parallel rows, the rollers of each row being supported on a common continuous axle that is supported on the ruler edges of the beams.

An embodiment example will now be described in conjunction with the drawings, wherein.

Figure 1:
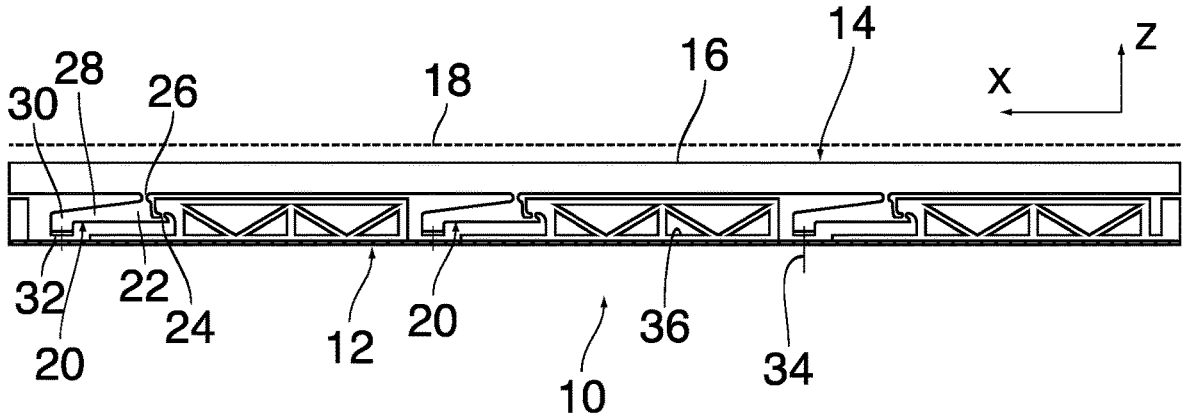
FIG. 1 shows, in a longitudinal section, a single beam of a support structure according to the invention.

A support structure for a sheet conveyer belt in a printer, e.g. an ink jet printer, is constituted by a plurality of parallel beams 10 that extend in a transport direction x of the conveyer. FIG. 1 shows one of these beams 10 in a longitudinal section.

The beam 10 has a base part 12, which is the lower part in FIG. 1 and shown in section, and a ruler part 14 which is the upper part of the beam in FIG. 1. A top edge 16 of the ruler part 14, together with corresponding ruler edges of a number of further beams 10 (FIG. 2) defines the posture and shape of a support surface 18 that has been shown in FIG. 1 only schematically in the form of dashed line.

The ruler part 14 is connected to the base part 12 by a number of adjustment mechanisms 20 (three in this example) which are evenly distributed over the length of the beam 10. Each adjustment mechanism 20 comprises a lever 22 that is pivotable relative to the base part 12 about a fixed fulcrum 24 and is connected to the ruler part 14 via an articulated link 26. The lever 22 has an adjustment arm 28 that extends from the articulated link 26 in a direction away from the fulcrum 24 and has at its free end 30 a tab 32 that is adjustable relative to the base part 12 by means of an adjustment screw 34. The adjustment screws 34 have been shown only schematically in FIG. 1 and are arranged such that, by tightening the adjustment screw 34, the tab 32 is drawn closer to the bottom of the base part 12, so that the lever 22 rotates counter-clockwise in FIG. 1 about the fulcrum 24, whereby a bending strain is applied to the ruler part 14 via the articulated link 26.

The adjustment movement controlled by the adjustment screw 34 is a movement in a first direction z which is the vertical direction in FIG. 1 and is normal to the support surface 18, whereas the ruler edge 16 of the beam 10 extends in the transport direction (second direction) x which is parallel to the support surface 18 and is the direction in which the media sheets are conveyed on the conveyer belt (not shown) that is supported on the support surface 18.

Figure 2:
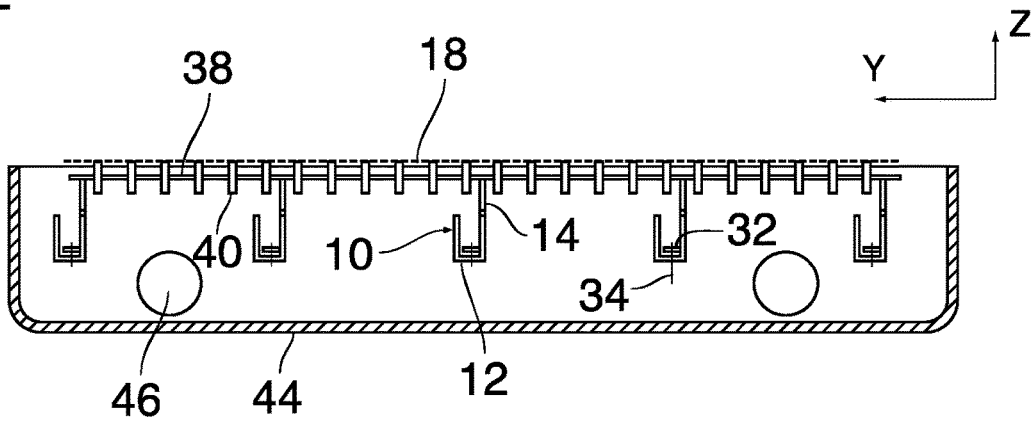
FIG. 2 is a cross-sectional view of the support structure incorporated in a suction box for supporting a conveyer belt in a printer.

FIG. 2 shows a plurality of the beams 10 in a sectional view taken along a direction y which is normal to the directions x and z and is the transverse direction of the conveyer belt. It can be seen that the base part 12 of each beam 10 has a U-shaped cross-section with upwardly extending legs, and the ruler part 14 constitutes an upward extension of one of the two legs. Thus, the base part 12, the ruler part 14 and the levers 22 of all adjustment mechanisms 20 of a single beam can be formed in one piece from a sheet metal, wherein the contours of the levers 20, the fulcrums 24 and the links 26 are cut by means of a laser cutter, for example. The ruler part 14 is shaped as a strip of sheet metal with a uniform height which has been dimensioned so as to obtain just the right amount of bending stiffness in the z-direction for smoothly adjusting the curvature of the ruler edge 16.

As can be seen in FIG. 1, the leg of the U-shaped base part 12 that is in the same plane as the ruler part 14 has cut-outs 36 leaving only a lightweight but rigid framework that supports the fulcrums 24.

Figure 3:
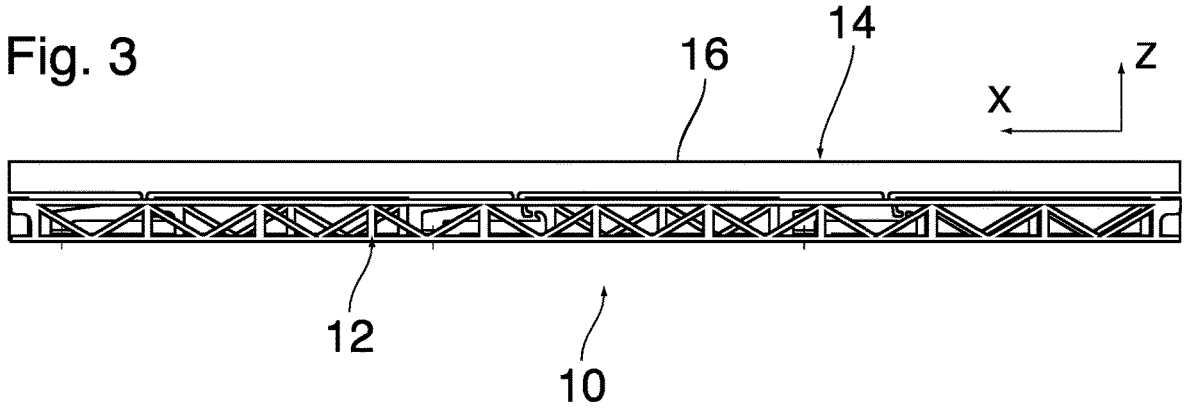
FIG. 3 is a side view of a single beam.

The other leg of the base part 12 is constituted by a similar framework, as can be seen in a side view in FIG. 3.

Returning to FIG. 2, it can be seen that the ruler edges of the beams 10 support an axle 38 which extends over the entire width of the conveyer belt and carries a set of rollers 40 the apexes of which constitute the support surface 18.

Figure 4:
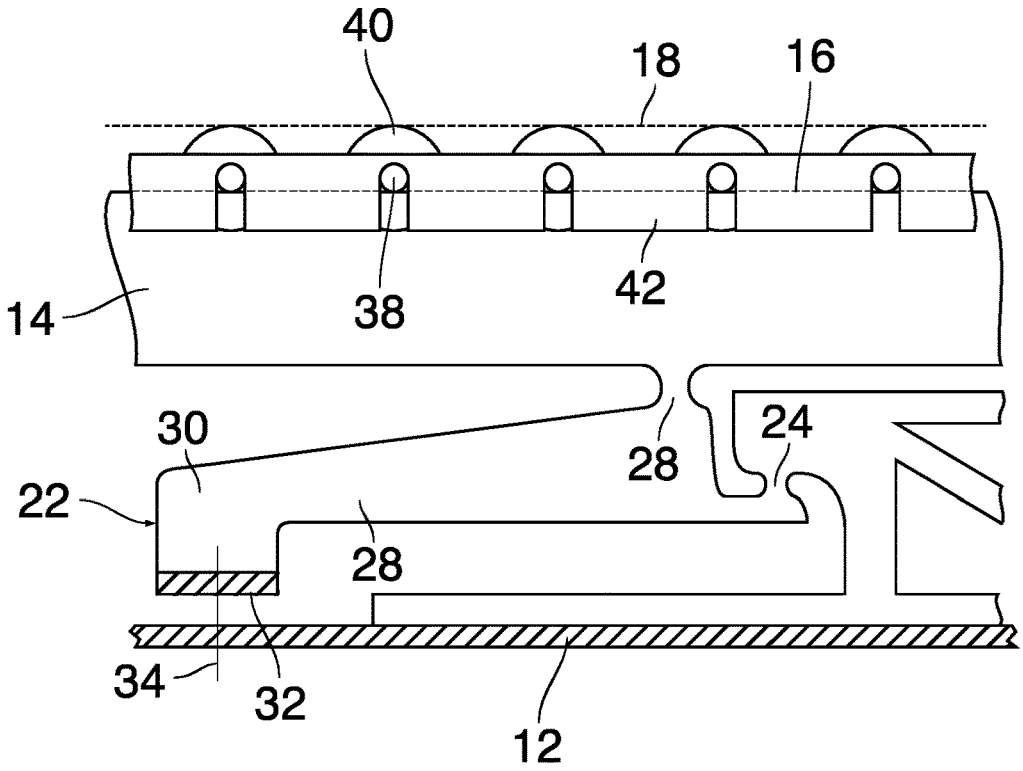
FIG. 4 is an enlarged view of a part of the beam.

More particularly, as will be seen in FIG. 4, the support surface 18 is defined by a plurality of such sets of rollers 40 supported on parallel axles 38 in the form of a two-dimensional array. FIG. 4 further shows a clamp member 42 with which the axles 38 are biased against the ruler parts 14 of the beams and held in engagement with the ruler edges 16.

As is shown in FIG. 2, the support surface 18 constituted in this way forms the top surface of a suction box 44 to which a vacuum is applied via suction ports 46, so that air is drawn-in through the gaps between the rollers 40 and the conveyer belt is safely drawn against the support surface 18. The conveyer belt is made of an air-permeable material so that media sheets carried on the conveyer belt are also sucked against the belt and, consequently, against the support surface 18.

Figure 5:
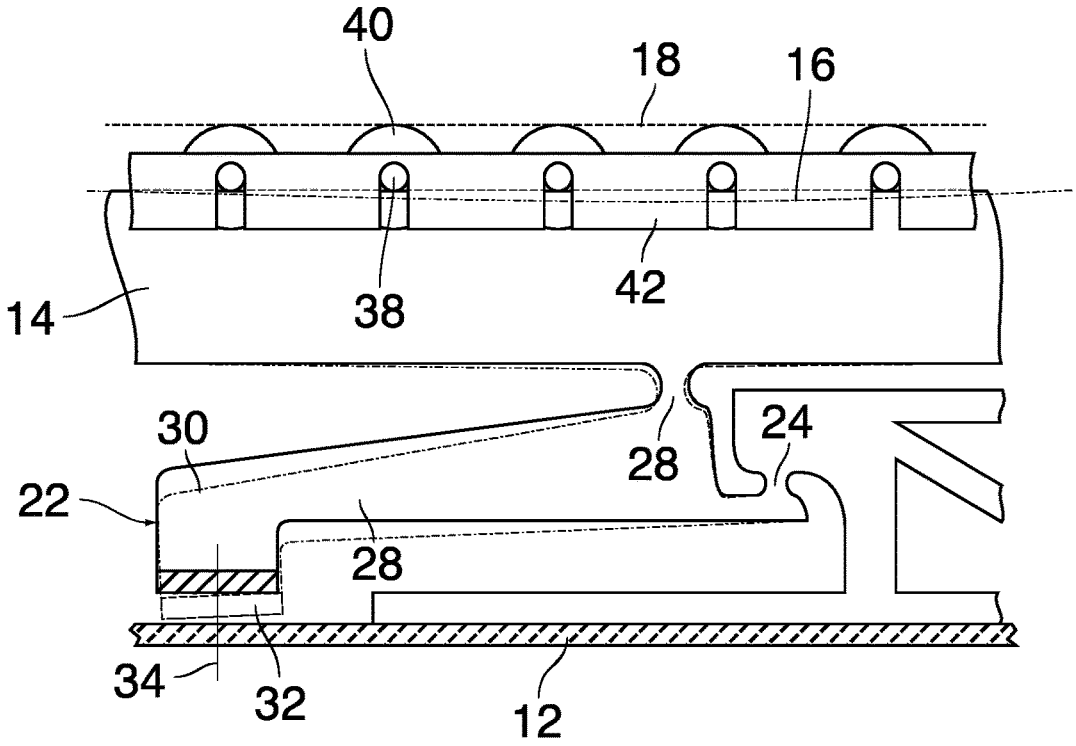
FIG. 5 illustrates an adjustment operation in the part of the beam shown in FIG. 4.

If, for any reason, the support surface 18 happens to be not perfectly flat but to show some curvature, such curvature can be eliminated by adjusting the height and the curvature of the ruler parts 14 of the beams. In particular, if a ruler edge 16 of a single beam is found to be curved, this curvature can be eliminated by suitably rotating one or more of the adjustment screws 34, so that the lever 22 is rotated and the ruler part 14 is bent, as has been shown in dot-dashed lines in FIG. 5.

If each beam 10 has exactly three adjustment mechanisms 20, the curvature of the ruler edge 16 can be described by a quadratic function. More generally, if the number of adjustment mechanisms is n, then the curvature of the ruler edge 16 can be described by a polynomial of n-th degree. In any case, by suitably adjusting the adjustment screws 34, the curvature can be eliminated almost completely.

If the support surface 18 happens to be curved in the direction x, i.e. in the conveying direction of the belt, then the curvature may be eliminated by suitably adjusting the heights of the several beams 10 independently of one another. Suitable adjustment mechanisms for this overall height adjustment of the beams are state of the art and have not been shown here.

The invention claimed is:

1. A support structure defining a flat support surface for supporting a web material, the support structure comprising:

a number of beams, each of the number of beams having a cross-section elongated in a first direction normal to the support surface, and having a ruler edge extending in a second direction in parallel with the support surface, the support surface being defined by the ruler edges of the number of beams; and a number of adjustment mechanisms for adjusting the positions of the ruler edges in the first direction, wherein each of the number of beams has a base part and a ruler part, the ruler part defining the ruler edge and being connected to the base part by at least three adjustment mechanisms distributed over a length of the beam, and wherein each adjustment mechanism comprises a lever that is pivotable relative to the base part about a fixed fulcrum, is connected to the ruler part by an articulated link, and has an adjustment arm with a free end that is adjustable in the first direction relative to the base part.

2. The support structure according to claim 1, wherein the base part, the ruler part and the levers of each of the number of beams are constituted by a one-piece sheet metal in which the contours of the levers, the fulcrums and the links have been cut-out.

3. The support structure according to claim 2, wherein the base part has a U-shaped cross-section with two parallel legs, the ruler part being configured as an extension of one of the two parallel legs.

4. The support structure according to claim 3, wherein a free end of each lever has a tab bent at right angles from the plane of the lever and the ruler part, and each adjustment mechanism comprises an adjustment screw passing through the tab and a base of the U-shaped base part.

5. The support structure according to claim 1, wherein a conveyer belt is supported on the support surface, wherein a plurality of beams are arranged in parallel to each other, such that the second direction is a direction of transport of the conveyer belt, and wherein a plurality of axles extend in a direction transverse to the second direction and are supported on the ruler edges of each of the number of beams, each axle carrying a set of rollers the apexes constituting the support surface.

6. The support structure according to claim 1, wherein the support surface constitutes a top wall of a suction box.

7. The support structure according to claim 6, wherein the suction box comprises suction ports for forming a connection to a suction source.

8. The support structure according to claim 1, wherein a distance between the free end and the fulcrum measured along a length of the ruler exceeds a distance between the articulated link and the fulcrum.

9. The support structure according to claim 8, wherein the distance between the free end and the fulcrum is at least twice the distance between the articulated link and the fulcrum.

10. The support structure according to claim 9, wherein the distance between the free end and the fulcrum is at least five times the distance between the articulated link and the fulcrum.

11. A media platen for supporting media sheets in a printer, comprising the support structure according to claim 1.

12. A printer, comprising the media platen according to claim 11.

13. The printer according to claim 12, wherein the printer is a sheet printer comprising a sheet input device for feeding sheets towards the media platen.

14. The printer according to claim 12, wherein the media platen comprises a conveyer belt provided moveably on the support surface, wherein a plurality of beams are arranged in parallel to each other, such that the second direction is a direction of transport of the conveyer belt, and wherein a plurality of axles extend in a direction transverse to the second direction and are supported on the ruler edges of each of the beams, each axle carrying a set of rollers, the apexes of set of rollers constituting the support surface.

15. The printer according to claim 14, wherein the conveyer belt is air-permeable.

* * * * *